US012392127B2

(12) United States Patent
Dunne et al.

(10) Patent No.: US 12,392,127 B2
(45) Date of Patent: Aug. 19, 2025

(54) RAPID SET SHELTER

(71) Applicant: Advanced Containment Systems, Inc., Houston, TX (US)

(72) Inventors: Philip J. Dunne, Houston, TX (US); Andrew J. Grygiel, Houston, TX (US)

( * ) Notice: Subject to any disclaimer, the term of this patent is extended or adjusted under 35 U.S.C. 154(b) by 0 days.

(21) Appl. No.: 17/961,526

(22) Filed: Oct. 6, 2022

(65) Prior Publication Data

US 2023/0106634 A1 Apr. 6, 2023

Related U.S. Application Data

(60) Provisional application No. 63/253,110, filed on Oct. 6, 2021.

(51) Int. Cl.

| | |
|---|---|
| ***E04B 1/344*** | (2006.01) |
| ***E04B 1/343*** | (2006.01) |
| ***E04H 9/00*** | (2006.01) |
| ***E04H 9/14*** | (2006.01) |
| ***E04H 9/16*** | (2006.01) |

(52) U.S. Cl.

CPC ..... *E04B 1/344* (2013.01); *E04B 1/34384* (2013.01); *E04B 1/3445* (2013.01); *E04H 9/00* (2013.01); *E04H 9/14* (2013.01); *E04H 9/16* (2013.01)

(58) Field of Classification Search

CPC .... E04B 1/344; E04B 1/3445; E04B 1/34384; E04B 2001/34389; E04H 9/00; E04H 9/04; E04H 9/14; E04H 9/16; H02S 20/23

See application file for complete search history.

(56) References Cited

U.S. PATENT DOCUMENTS 3,231,942 A * 2/1966 Charles ..... A63H 33/008 446/478
3,984,949 A * 10/1976 Wahlquist ..... E04B 1/3445 52/143

(Continued)

FOREIGN PATENT DOCUMENTS

CH 622052 A5 * 3/1991
GB 2225358 A * 5/1990 ..... E04B 1/3445

(Continued)

*Primary Examiner* — Jessie T Fonseca

(74) *Attorney, Agent, or Firm* — Ferguson Braswell Fraser Kubasta PC

(57) ABSTRACT

A device comprising: a first sidewall connected to a bottom wall via a first hinge and connected to a top wall via a second hinge, wherein a third hinge is disposed in the first sidewall about parallel to both the first hinge and the second hinge; a second sidewall connected to the bottom wall via a fourth hinge and connected to the top wall via a fifth hinge, wherein a sixth hinge is disposed in the second sidewall about parallel to both the fourth hinge and the fifth hinge, wherein the second sidewall is opposite the first sidewall, and wherein the third hinge of the first sidewall and the sixth hinge of the second sidewall have about a co-equal height along the side first and second sidewalls, relative to the bottom wall; a third sidewall connected to the bottom wall via a seventh hinge; and a fourth sidewall connected to the bottom wall via an eight hinge, wherein the fourth sidewall is configured to fold onto the bottom wall, and wherein the third sidewall is configured to fold onto the fourth sidewall in a collapsed position of the device.

13 Claims, 11 Drawing Sheets

(56) References Cited

U.S. PATENT DOCUMENTS 4,380,836 A * 4/1983 Braxton ..... E04B 1/3445 D25/16
4,726,155 A * 2/1988 Nahmias ..... E04B 1/344 52/79.5
5,493,818 A * 2/1996 Wilson ..... E04B 1/3445 52/79.5
5,950,568 A * 9/1999 Axelrod ..... A01K 1/033 119/499
10,206,501 B1 * 2/2019 Kindred, Jr. ..... E04B 1/3445
2005/0145192 A1 * 7/2005 Axelrod ..... A01K 1/0245 119/499
2008/0121188 A1 * 5/2008 Axelrod ..... A01K 1/033 119/499
2010/0025397 A1 * 2/2010 Krohn ..... B65D 88/522 220/6
2012/0186166 A1 * 7/2012 Casto ..... E04B 1/3445 29/897.3
2012/0317898 A1 * 12/2012 Strachan ..... E04C 2/34 52/79.5
2013/0139449 A1 * 6/2013 Ho ..... E04H 1/125 52/71
2014/0144088 A1 * 5/2014 Heger ..... E04B 1/34384 52/79.5
2015/0107277 A1 * 4/2015 Moore ..... F24F 1/027 62/298
2017/0335561 A1 * 11/2017 Wickramasekera .. E04H 1/1205
2020/0071925 A1 * 3/2020 Shum ..... E04B 1/68
2021/0404170 A1 * 12/2021 Hariri ..... E04B 1/34336
2023/0063327 A1 * 3/2023 Li ..... E04B 1/3445

FOREIGN PATENT DOCUMENTS

WO WO-9102869 A1 * 5/1990 ..... E04B 1/3445
WO WO-2020227768 A1 * 11/2020 ..... E04B 1/34363

* cited by examiner

RAPID SET SHELTER

CROSS-REFERENCE TO RELATED APPLICATIONS

This application claims the benefit of U.S. Provisional Patent Application No. 63/253,110, entitled "RAPID SET SHELTER", filed on Oct. 6, 2021, which is incorporated by reference for all purposes.

BACKGROUND

Rapid transport and erection of shelters is desirable for many projects or applications. Deployable shelters are often used in situations where a temporary or seasonal shelter is required. Examples include emergency and disaster relief situations, athletic events, entertainment venues, and livestock transportation. Such shelters range from soft-sided tents to prefabricated, re-locatable buildings.

SUMMARY

In general, in one aspect, one or more embodiments related to a device comprising: a first sidewall connected to a bottom wall via a first hinge and connected to a top wall via a second hinge, wherein a third hinge is disposed in the first sidewall about parallel to both the first hinge and the second hinge; a second sidewall connected to the bottom wall via a fourth hinge and connected to the top wall via a fifth hinge, wherein a sixth hinge is disposed in the second sidewall about parallel to both the fourth hinge and the fifth hinge, wherein the second sidewall is opposite the first sidewall, and wherein the third hinge of the first sidewall and the sixth hinge of the second sidewall have about a co-equal height along the side first and second sidewalls, relative to the bottom wall; a third sidewall connected to the bottom wall via a seventh hinge; and a fourth sidewall connected to the bottom wall via an eight hinge, wherein the fourth sidewall is configured to fold onto the bottom wall, and wherein the third sidewall is configured to fold onto the fourth sidewall in a collapsed position of the device.

BRIEF DESCRIPTION OF DRAWINGS

Like elements in the various figures are denoted by like reference numerals for consistency.

DETAILED DESCRIPTION

Figure 1:
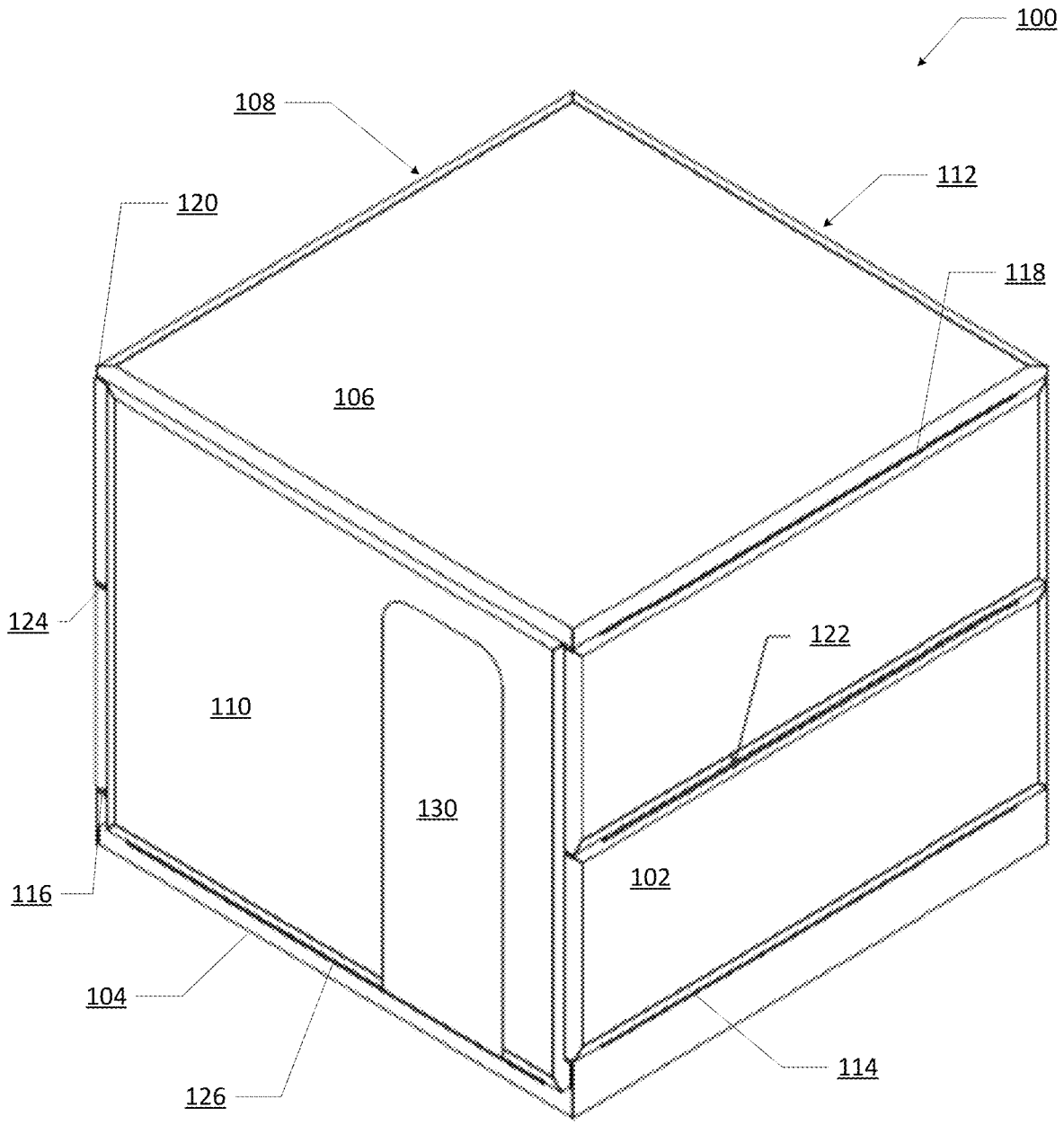
FIG. 1 is an isometric view of the collapsible shelter when erected, in accordance with one or more embodiments of the invention.
Figure 3:
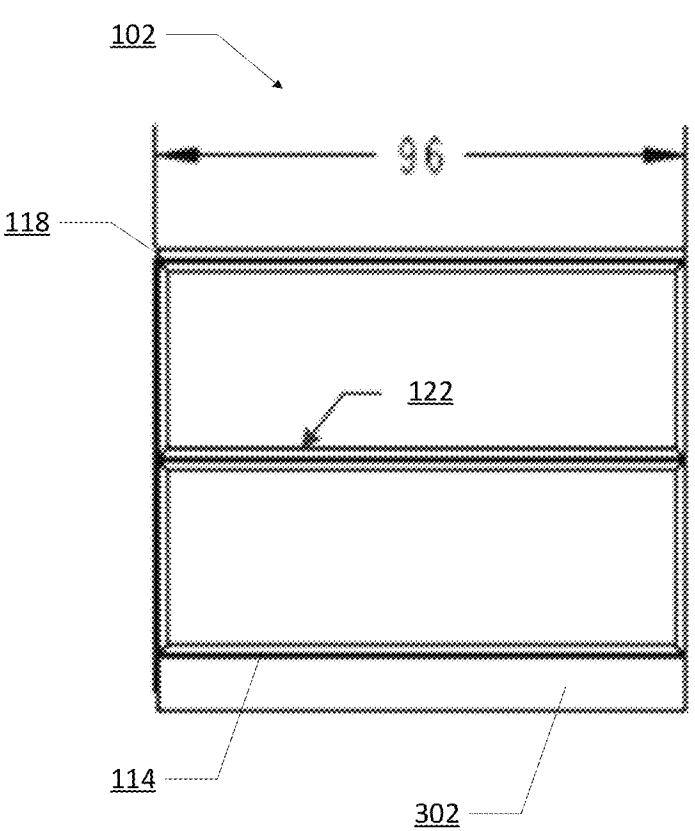
FIG. 3 is a planar, edge-on views of a side-facing sidewall of the collapsible shelter, in accordance with one or more embodiments of the invention.

Specific embodiments of the invention will now be described in detail with reference to the accompanying figures. Like elements in the various figures are denoted by like reference numerals for consistency.

In general, embodiments of the invention relate to improved shelters that can be quickly transported and deployed to house people who have been displaced from permanent homes or facilities. More particularly, the one or more embodiments are directed at collapsible shelters that solve an issue of a need for a hard-shelled shelter that can be quickly deployed to protect individuals from the environment along with providing security.

The shelter of the one or more embodiments may be formed of a rigid, lightweight, insulated, composite wall construction. The shelter may be formed from one or more materials that are water resistant, rust and rot resistant, resistant to penetration by vermin, and/or environmentally sealed. The shelter may be erected in minutes using a few people (e.g., 4-5) without the need for equipment, tools, or hardware. Alternatively, tools or machinery may be used to erect a shelter.

Because the shelter may be quickly deployed, the shelter may be termed a "Rapid set shelter" in some embodiments.

Multiple shelters may be collapsed and stacked on top of each other. The collapsed shelters may be placed on a pallet in stacks, and then transported by moving the pallet. For example, multiple collapsed shelters may be loaded onto a pallet, and then multiple pallets may be loaded onto a truck or trailer. In this manner, 30 or more collapsed shelters may be transported on a single truck or trailer.

In some cases, tools for construction of shelters will not be readily available, which creates the need for a shelter which can be quickly setup with no tools. Thus, the one or more embodiments address issues of providing a hard walled shelter to people who have been displaced from permanent homes or facilities. The shelter requires no tools to setup and use as a simple shelter, with all components to deploy are attached together. In some instances, the shelter may be characterized as a "rapid set shelter," as the shelter may be assembled in about 15 minutes or less.

Attention is now drawn to the figures. FIG. 1 through FIG. 5 should be considered together as one example of a label of the one or more embodiments, and thus share common reference numerals.

FIG. 1 is an isometric view of the shelter (100) in an erected configuration. The shelter (100) may be viewed as a set of sidewalls extending between a bottom wall (104), sometimes referred to herein as in as a "base" or "floor," and a top wall (106), sometimes referred to herein as a "roof."

Sidewalls (102, 108) are rotatably connected the bottom wall (104) via hinges (114, 116). In some embodiments, hinges (114, 116) may be continuous, rotatably connecting the sidewalls to the base along about an edge length of the sidewalls. Thus, in some embodiments, hinges (114, 116), as well as other hinges described herein, can be "piano hinges," as are known in the art.

Sidewalls (102, 108) are rotatably connected the top wall (106) via hinges (118, 120). In some embodiments, hinges (118, 120) may be continuous, rotatably connecting the sidewalls to the base along about an edge length of the sidewalls.

Figure 9A:
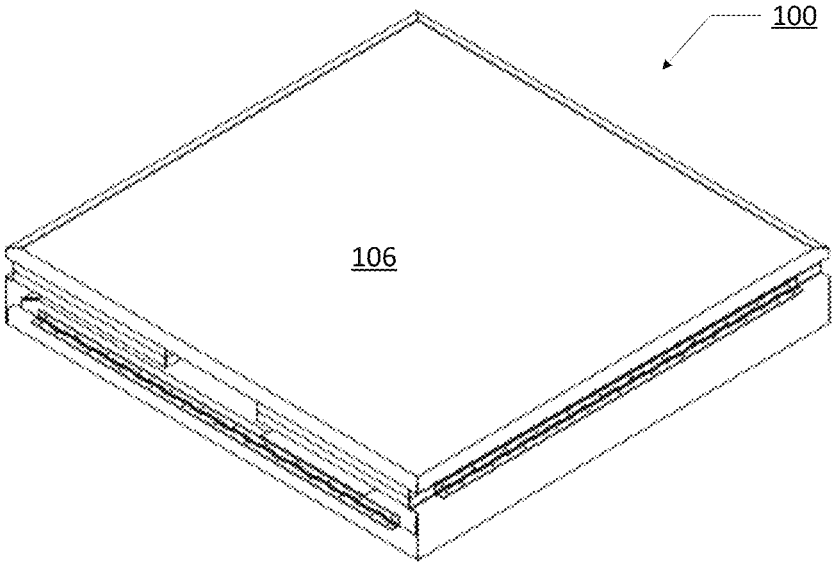
FIG. 9A is an isometric view of the collapsible shelter when collapsed, in accordance with one or more embodiments of the invention.
Figure 9B:
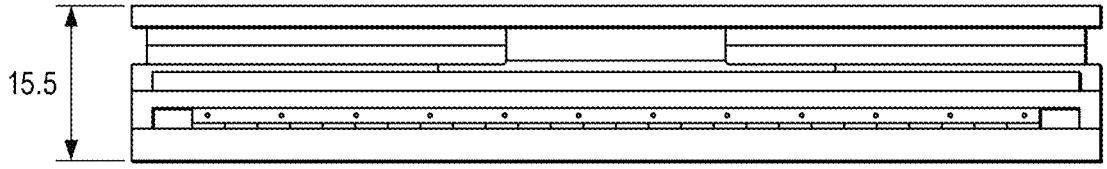
FIG. 9B is a planar, edge-on view of the collapsible shelter when collapsed, in accordance with one or more embodiments of the invention.

Hinges (122, 124) are disposed respectively in Sidewalls (102, 108). Hinge (122) is disposed about parallel to both hinge (114) and hinge (118). Likewise, hinge (124) is disposed about parallel to both hinge (116) and hinge (120). Hinges 122, 124) have about a co-equal height along Sidewalls (102, 108) relative to the bottom wall (104). The arrangement of hinges (114, 116, 118, 120, 122, 124) enable an accordion-style folding of sidewalls (102, 108) when shelter (100), as shown in FIG. 9.

Sidewall (110), sometimes referred to herein as a "front wall" or "door wall," is rotatably connected the bottom wall (104) via hinge (126). Sidewall (112), sometimes refer to as a "rear wall" or "window wall," is rotatably connected the bottom wall (104) via hinge (128).

One or more locking mechanisms (1000) (shown in FIG. 10) may be used to secure the Sidewalls (110, 112) to one or more of sidewalls (102, 108) and or top wall (106). The locking mechanisms (1000) can be a latch, clasp, clip, pin, and/or stay that is capable of engaging the roof and/or wall, essentially locking the Sidewall (110, 112) into place so as to provide monocoque support to the top wall (106).

The shelter (100) may be provided with a walk-in door, a window, or other useful features that may be placed in shelter (100) as features. For example, sidewall (110) may be provided with a door (130) to facilitate access to the interior of the shelter (100) when erected. Windows (e.g., window (400)) may also be provided for ventilation, natural lighting, and emergency ingress/egress.

Additional features may also be provided. for example, the shelter may be provided a power supply and a light (e.g., a 15-amp, 110-volt receptacle and a battery-operated LED light) that come preinstalled in the shelter. An optional air conditioning (AC) unit may be installed in an opening in the shelter that is designed to receive the AC unit. The AC unit may be installed after erection of the collapsible shelter and removed prior to collapse of the collapsible shelter. Furniture and equipment may be provided and added to collapsible shelter after erection. Some furniture may be collapsible and collapse with the shelter (e.g., a table or a cot installed and collapsible or foldable into a wall of the collapsible shelter).

Figure 6:
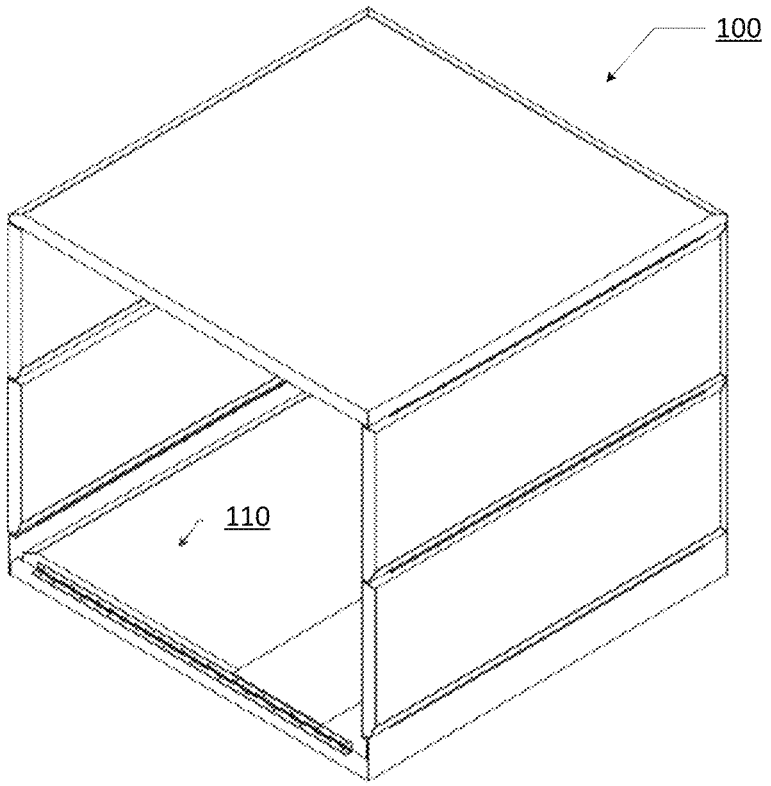
FIG. 6 is an isometric view of the collapsible shelter in a partially collapsed condition, in accordance with one or more embodiments of the invention.
Figure 7:
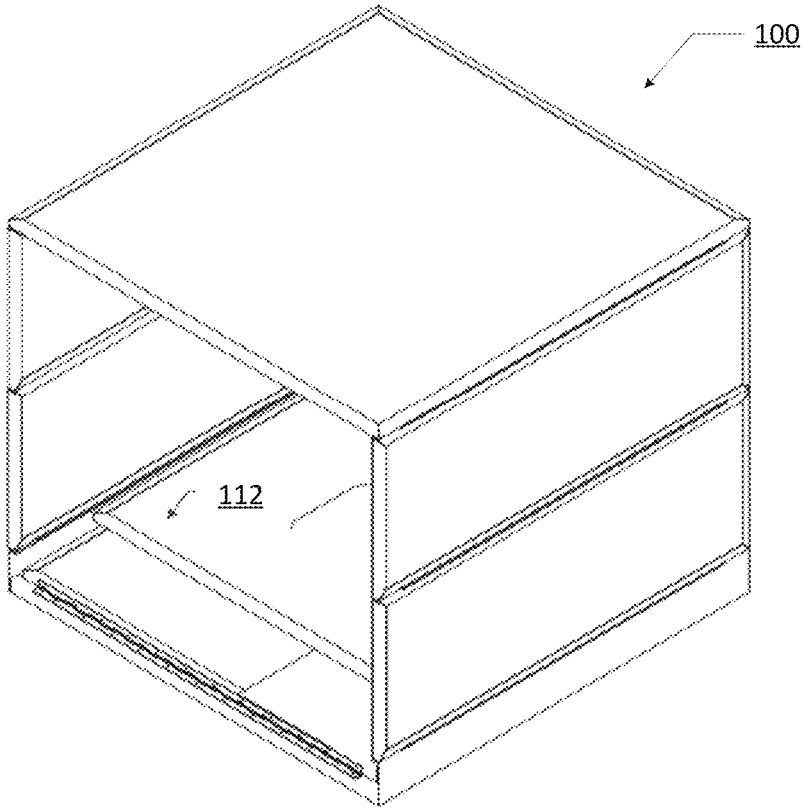
FIG. 7 is an isometric view of the collapsible shelter in a partially collapsed condition, in accordance with one or more embodiments of the invention.
Figure 8:
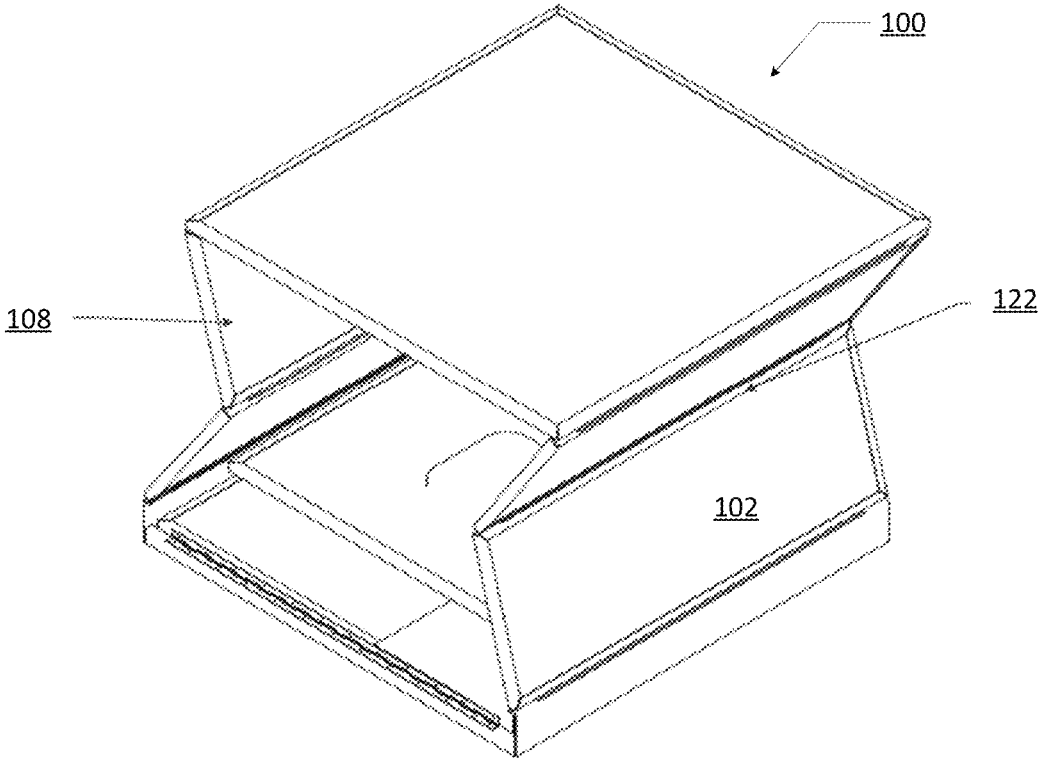
FIG. 8 is an isometric view of the collapsible shelter in a partially collapsed condition, in accordance with one or more embodiments of the invention.

In one or more embodiments, risers are connected to bottom wall (104) such that sidewalls (102, 108, 110, 112) are attached at varying heights to compensate for wall thickness when shelter (100) is in a collapsed state. For example, as shown in FIG. 6, the sidewall (110) may be configured to fold onto the bottom wall (104). as shown in FIG. 7, sidewall (112) may be configured to fold onto the sidewall (110). A riser (402) may be used in conjunction with sidewall (112). Riser (402) may raise an attachment point and pivot axis of sidewall (112) relative to bottom wall (104), thereby compensating for the thickness of sidewall (110). Continuing with the current example, sidewalls (102, 108) may be configured to fold onto the sidewall (112) as shown in FIG. 8.

Risers (302) may be used in conjunction with sidewalls (102, 108). Riser (302) may raise an attachment point and pivot axis of sidewalls (102, 108) relative to bottom wall (104), thereby compensating for the thickness of sidewalls (110, 112). In one or more embodiments, the risers (302, 402) may reduce or eliminate interference between sidewalls (102, 108, 110, 112) when the shelter (100) is collapsed, as shown in FIG. 9.

When collapsed, multiple shelters may be stacked on a pallet for efficient transport. The loaded pallet is loaded onto a truck. For example, a single tractor-trailer may transport 30 or more of the collapsible shelters in this manner.

Figure 10:
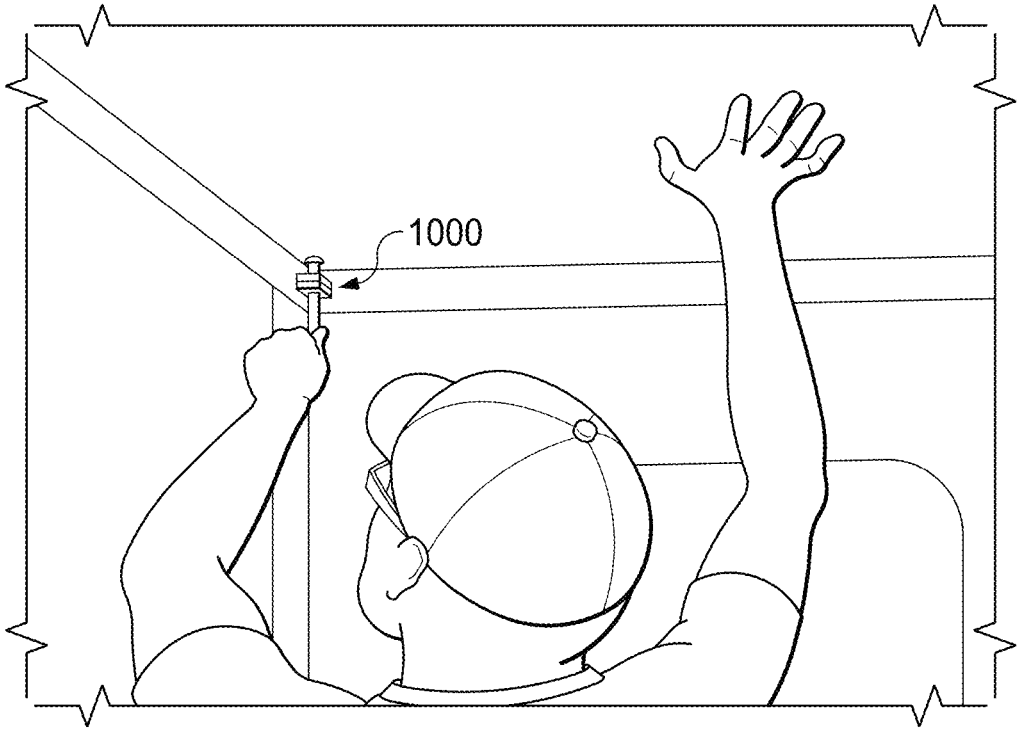
FIG. 10 is a locking mechanisms, in accordance with one or more embodiments of the invention.

In one specific embodiment, which does not limit other embodiments, the shelter (100) may have of varying sizes, but for example a length of 96" (see, e.g., FIG. 3) X a width of 96" (see, e.g., FIG. 2) X a height of 84" (see, e.g., FIG. 2). the shelter (100) may be is collapsible to different, smaller sizes, but for example length of 96" (see, e.g., FIG. 3) X a width of 96" (see, e.g., FIG. 2) X a height of 15.5" (see, e.g., FIG. 10).

Figure 11A:
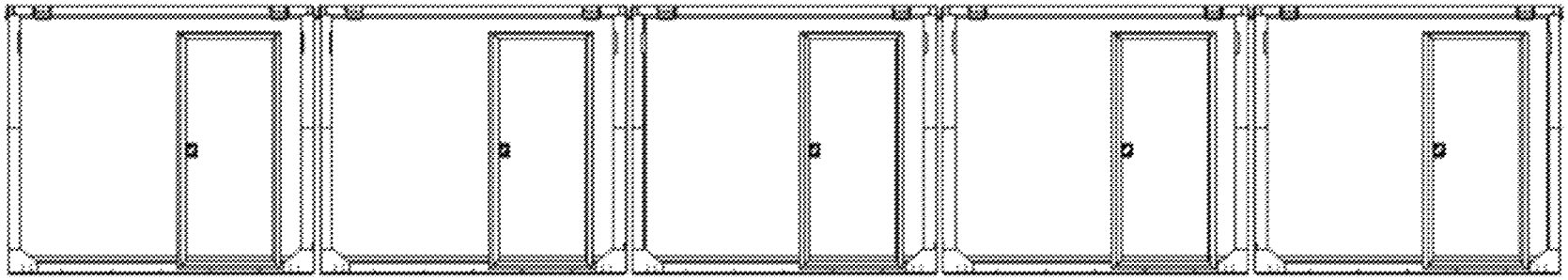
FIG. 11A shows a cluster of shelters from a front view, in accordance with one or more embodiments of the invention.
Figure 11B:
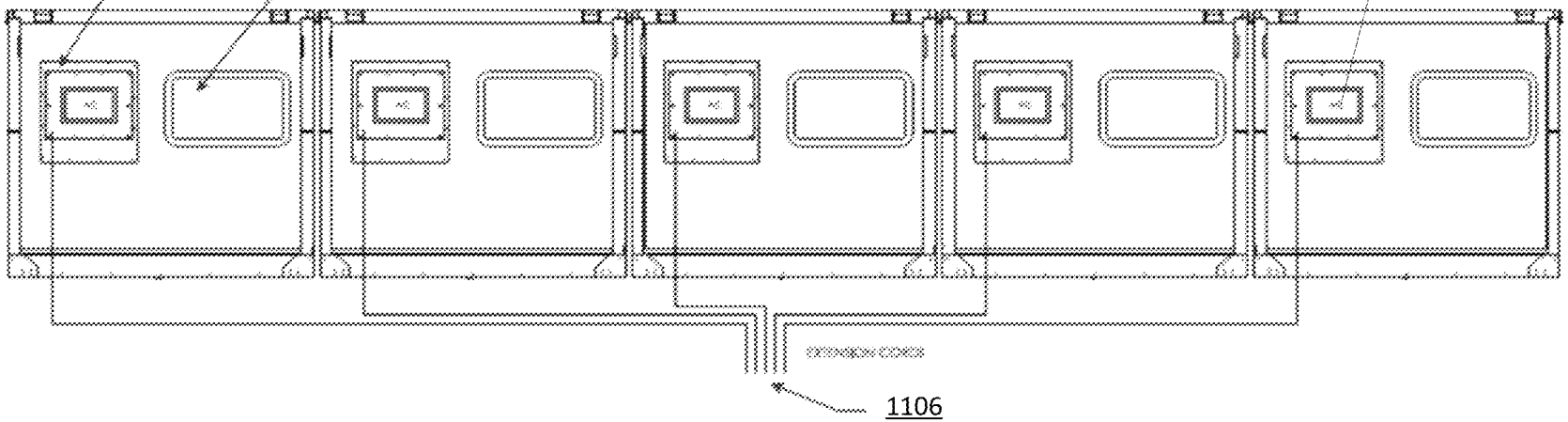
FIG. 11B shows the cluster of shelters in FIG. 14 from a back view, in accordance with one or more embodiments of the invention.

FIG. 11A shows a cluster of shelters from a front view (including doors in the shelters). The shelters may thus be put together in compact sets for emergency relief, homeless relief, etc. FIG. 11B shows the cluster of shelters in FIG. 11A from a back view.

An air conditioner adapter plate (1102) is built in to accommodate an optional air conditioner (1104). The air conditioner adapter plate (1102) may be initially supplied with a galvanized cover plate (not shown) which covers the available opening for the air conditioner. This cover is fastened in place using conventional fasteners. Once the fasteners are removed from the cover and the air conditioner is installed into the opening, the same fasteners are used to secure the air conditioner in place.

The air conditioner adapter plate (1102) may include one or more power receptacles. For example, one duplex 15 amp rated receptacle may be provided on the air conditioner adapter plate and can function any power requirements within the 15-amp limit including, but not limited to, powering of the air conditioner. The air conditioner adapter also provides a mounting surface for a battery-operated motion activated LED light.

Air conditioning units (e.g., air conditioning unit (1104)) are mounted into mounting frames disposed in the shelters. The AC unit may be installed after erection of the collapsible shelter and removed prior to collapse of the collapsible shelter. The air conditioning (AC) unit (1104) may be installed in an opening in the shelter that is designed to receive the AC unit.

The receptacle is connected to a (20 foot or more or less) outdoor-rated power cord (1106) to supply 120 volts 60 Hz (or more or less) from an available power source. Power cords (1106) may provide power to the air conditioning units, lights, batteries, and/or other powered equipment in the shelters. At this point, the air conditioner power cord (1106) is inserted into the duplex receptacle and if power has been supplied to the shelter, the air conditioner functions as a typical household unit. Low power requirements of the shelter allows for connecting multiple units to a single power source.

Figure 2:
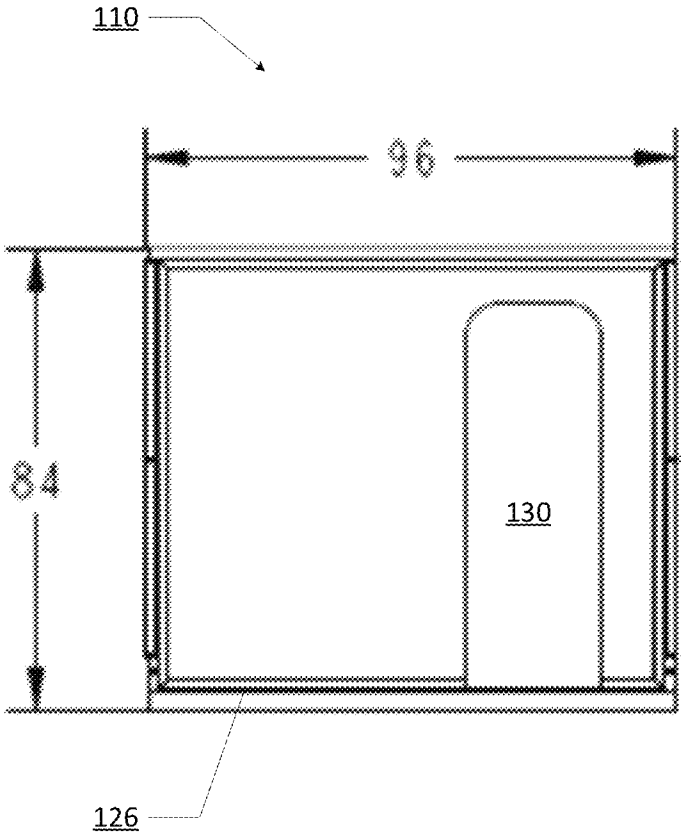
FIG. 2 is a planar, edge-on views of a front-facing sidewall of the collapsible shelter, in accordance with one or more embodiments of the invention.
Figure 5:
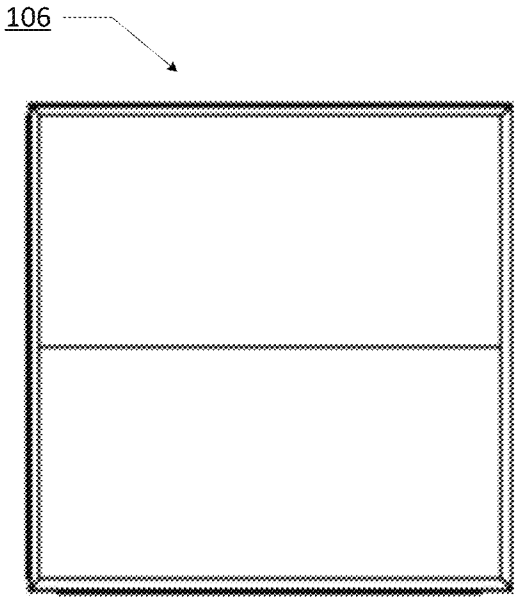
FIG. 5 is a planar, edge-on views of a top wall of the collapsible shelter, in accordance with one or more embodiments of the invention.
Figure 4:
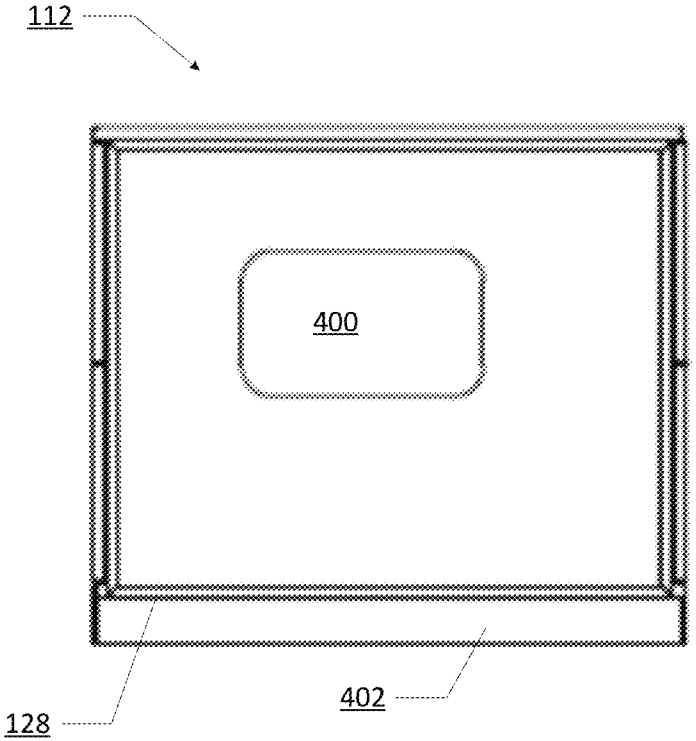
FIG. 4 is a planar, edge-on views of a back-facing sidewall of the collapsible shelter, in accordance with one or more embodiments of the invention.
Figure 12:
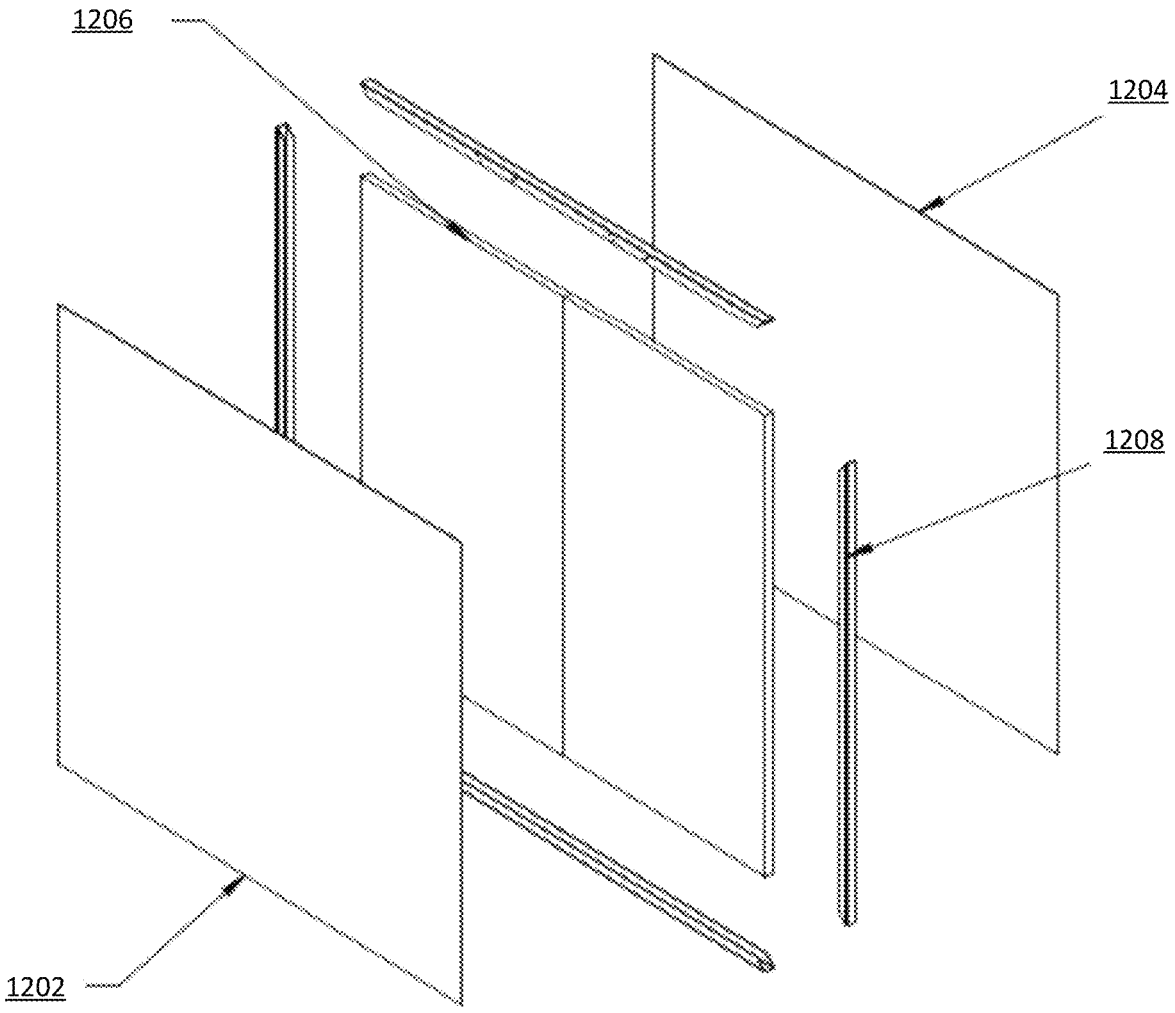
FIG. 12 shows an exploded view of a sidewall of a shelter, in accordance with one or more embodiments of the invention.

FIG. 12 shows an exploded view of a sidewall of FIG. 2.

Both the exterior surface (1202) and interior surface (1204) can be formed from a composite sheeting material, such as a fiber-reinforced polymer, that is rated for exterior use. The fibers can be glass (in fiberglass), carbon (in carbon-fiber-reinforced polymer), aramid, or basalt, as well as other known fibers such as paper, wood, or asbestos have been used. The polymeric matrix can be an epoxy, vinyl ester, or polyester, or other thermosetting material. A texture, such as pebbling, may be applied to the interior surface for aesthetic or safety purposes (i.e., o prevent slipping). For example, interior surface (1204) can be designed using a pebbled fiberglass reinforced plastic.

The interior and exterior surfaces are adhered to a core (1206). according to the embodiments, the core may impart one or more desirable characteristics to the shelter (100) such as weight reduction, acoustic dampening, thermal insulation, rigidity, and structural support. the core maybe fabricated from a foamed polymeric compound, such as polyethylene-vinyl acetate (PEVA), polyethylene (PE), nitrile rubber (NBR), polychloroprene, polyimide, polypropylene (PP), polystyrene (PS), polyurethane (PU), polyvinyl chloride (PVC), and silicone, as well as other suitable compounds.

A support channel (1208) may be connected around a perimeter of the sidewall. The support channel (1208) provide a structure to reinforce and hold together the layers shown. The support channel (1208) may add strength, and also serve as fastener or strengthener for the shelter (100) when erected. this support channel may be formed from light metals, and/or alloys thereof, having a desirable strength to weight ratio, such as aluminum, magnesium, and/or titanium. The support channel (1208) may provide a base for the attachment of handles, pegs, clasps, clips, etc. that may be provided inside and outside of the shelter to aid workers in gripping, erecting, and collapsing the shelter.

Figure 13:
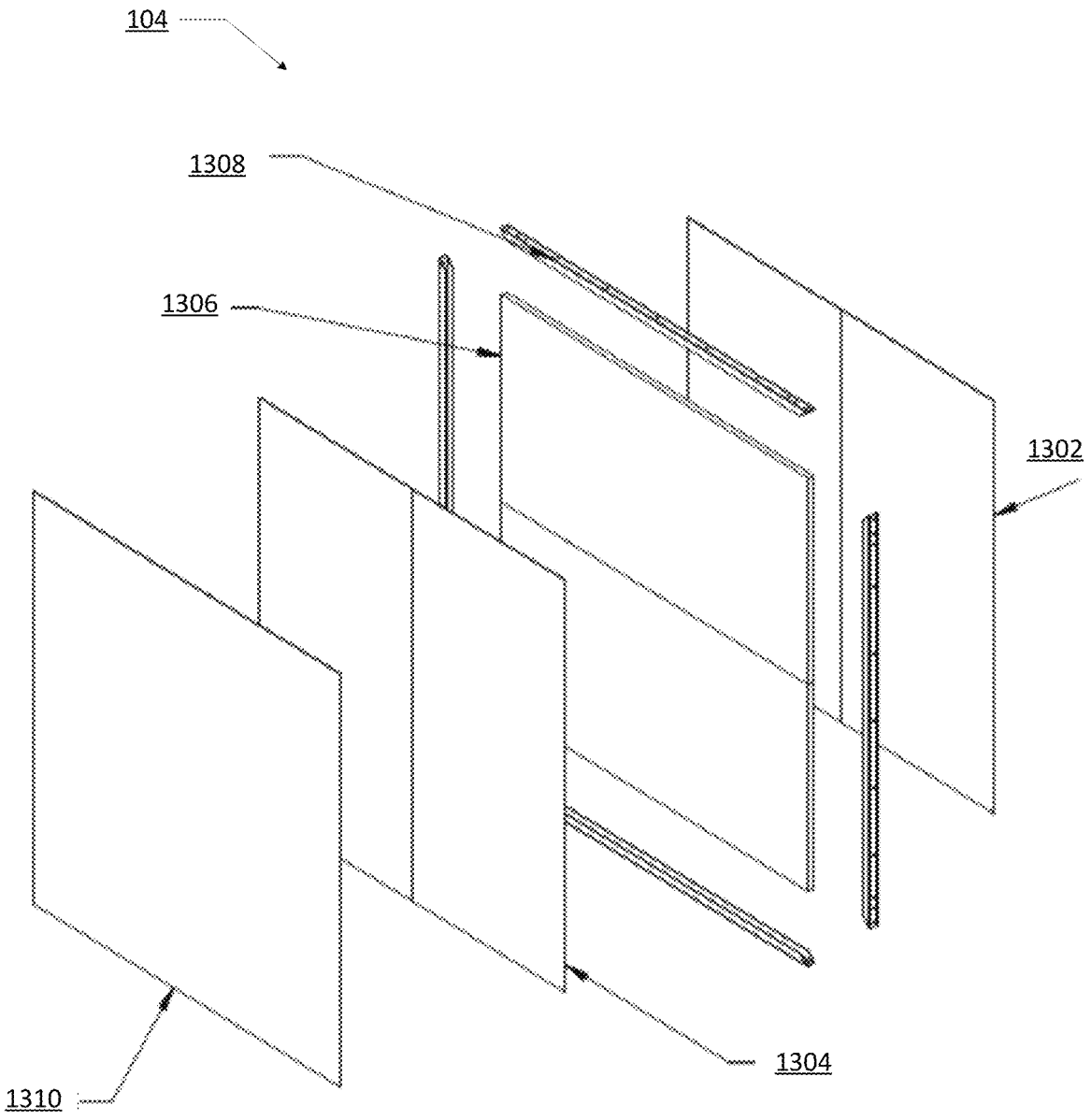
FIG. 13 shows an exploded view of the floor of a shelter, in accordance with one or more embodiments of the invention.

FIG. 13 shows an exploded view of a bottom wall of FIG. 2.

In one or more embodiments, the bottom wall (104) includes a baseplate (1302). The base plate (1302) as a skid plate to protect the shelter when contact is made with the ground. The base plate (1302) may allow the shelter to be dragged over abrasive surfaces, such as asphalt or concrete, while minimizing damage to the shelter. The base plate (1302) may be formed from an abrasion-resistant material that is suitable for reducing and/or preventing damage to the underside of the shelter (100). For example, and one specific embodiment, the base plate (1302) is one or more metal sheets of 20 gauge cold-rolled steel (CRS).

The bottom wall (104) includes a top skin (1304). The top skin (1304)) may be formed from an abrasion-resistant material that is suitable for reducing and/or preventing damage to the underside of the shelter (100). For example, and one specific embodiment, the top plate (1304) is one or more metal sheets of 22 gauge cold-rolled steel (CRS).

A core (1306) is sandwiched between the base plate (1302) and the (top skin 1304). the core (1306) can be formed of any foamed polymeric material, such as the materials suitable for use as core (1206). core (1306) can provide one or more desirable characteristics, while also reducing the overall weight of bottom wall (104).

A flooring (1310) may optionally be adhered to top skin (1304). The flooring (1310) Can be formed of any suitable material that provides a durable anti-slip, or non-skid surface for the interior of shelter (100). For example, the flooring (1310) may be formed from a durable thermoplastic resin or vinyl, such thermoplastic polyolefin.

A support channel (1308) may be connected around a perimeter of the bottom wall. The support channel (1308) provide a structure to reinforce and hold together the layers shown. The support channel (1308) may add strength, and also serve as fastener or strengthener for the shelter (100) when erected. this support channel may be formed from light metals, and/or alloys thereof, having a desirable strength to weight ratio, such as aluminum, magnesium, and/or titanium. The support channel (1308) may provide a base for the attachment of handles, pegs, clasps, clips, etc. that may be provided inside and outside of the shelter to aid workers in gripping, erecting, and collapsing the shelter.

The configuration of bottom wall (102) illustrated in FIG. 13 allows for the shelter (100) to be placed on uneven surfaces and unimproved surfaces, bottom wall (102) has the strength to withstand handling equipment used to transport the shelter. Thus, the one or more embodiments are not necessarily limited to the specific examples provided herein.

Figure 14:
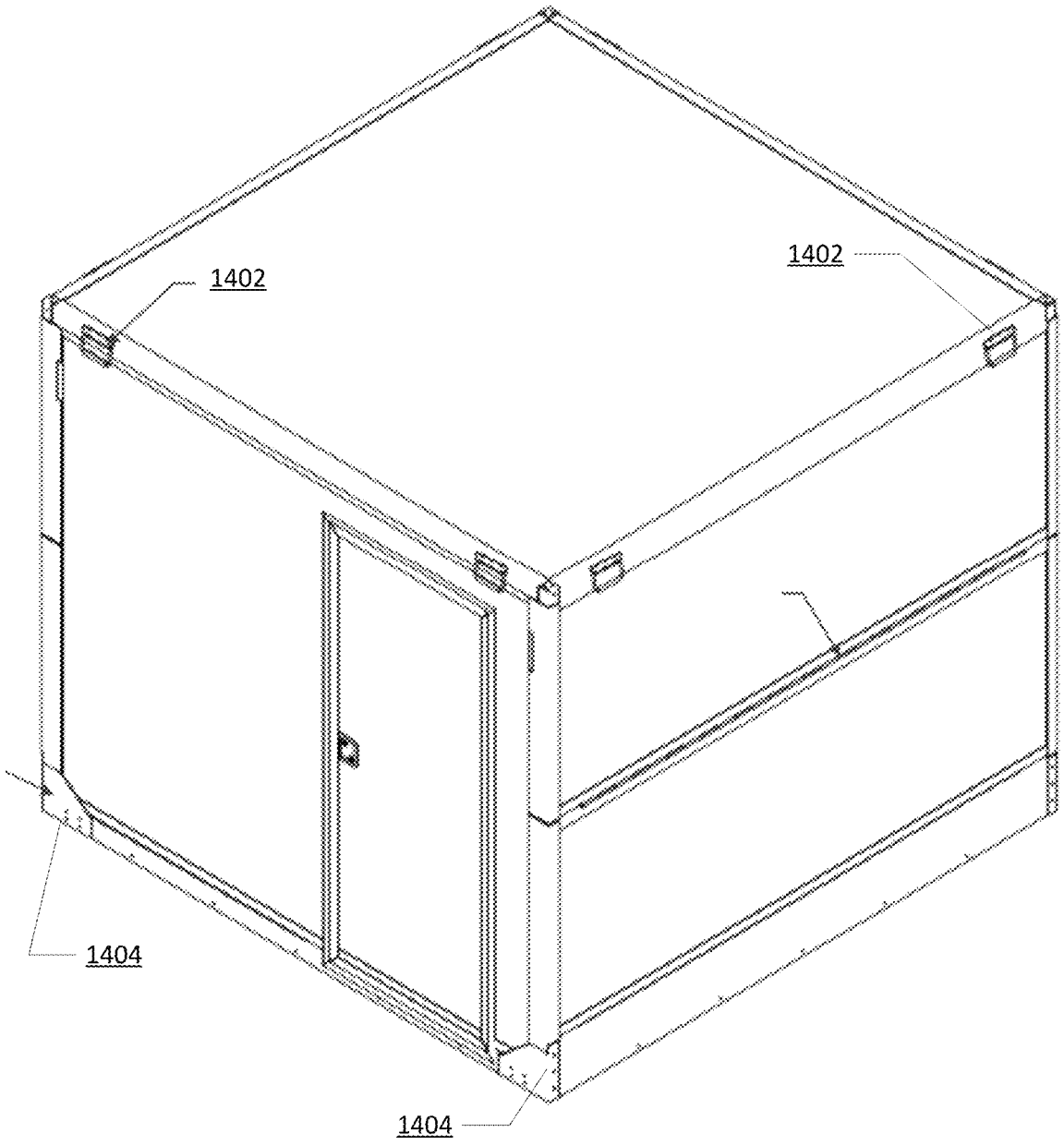
FIG. 14 shows an alternative embodiment of an erect shelter, in accordance with one or more embodiments of the invention.

FIG. 14 shows an alternative embodiment of an erect shelter. The top wall (106) incorporates multiple folding grab handles (1402). Handles (1402) are provided to aid in collapsing and erecting the shelter (100). Reinforcing plates or brackets (1404) may be provided. Both Handles (1402) and brackets (1404) are attached to support channels, such as the support channels (1208, 1308) shown in FIGS. 12 and 13.

With the use of the handles (1402) on the roof edges, personnel can lift the top wall (106) into position. The double folding sidewalls (102, 108) follow the attached roof into their position.

While the figures may show a configuration of components, other configurations may be used without departing from the scope of the invention. For example, various components may be combined to create a single component. As another example, the functionality performed by a single component may be performed by two or more components.

Figure 15:
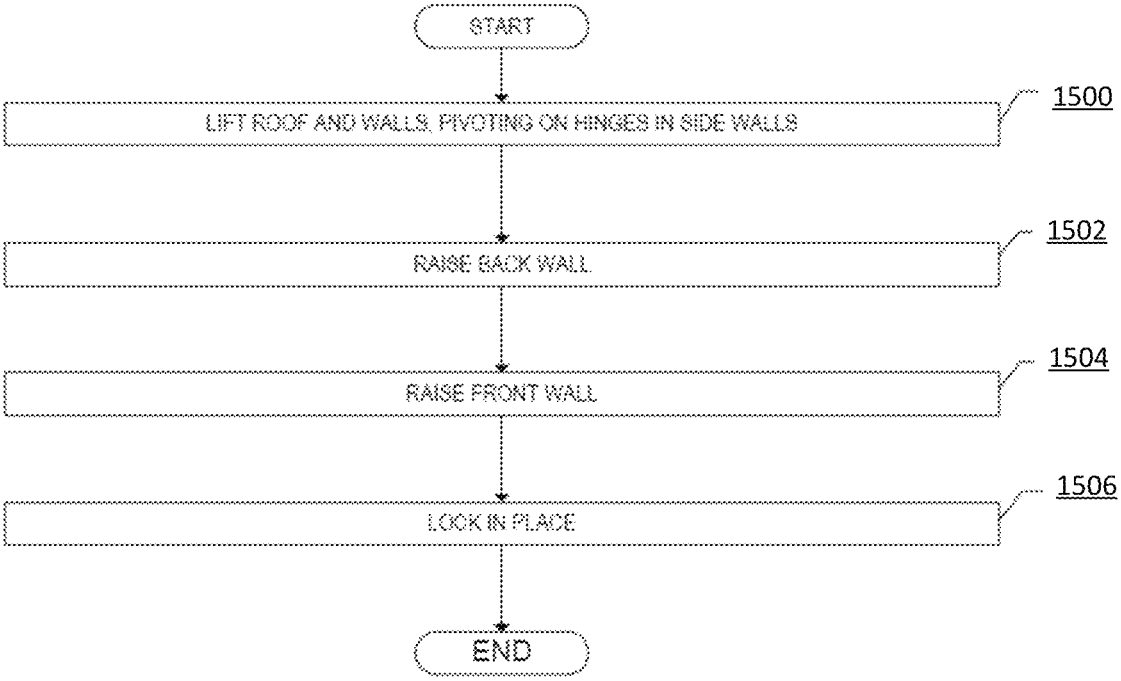
FIG. 15 shows a method of erecting a collapsible shelter, in accordance with one or more embodiments of the invention.

FIG. 15 shows a method of erecting a collapsible shelter.

In use, The Rapid set shelter, when starting from the collapsed position, is placed into the desired location. With the use of the folding handles on the roof edges, personnel lift the roof into position (step 1500). The double folding walls follow the attached roof into their position.

While the roof is held in place, an individual will deploy the back wall (step 1502), which is currently in a collapsed position over the collapsed door wall. The window wall is attached to the floor using a hinge, this allows for an individual to easily rotate the wall into the standing position.

Likewise, the front wall, which is currently in a collapsed position over the floor, can now be deployed (step 1504) into place in the same manner as the back wall. The front wall is attached to the floor using a hinge, this allows for an individual to easily rotate the wall into the standing position.

The front wall and the back wall then contacts one or more gasket on the double folding wall edges contained by an exterior angle as a hard stop. Once this contact is made, locking mechanisms on the front wall and the back wall engage one or more of the roof or sidewalls, locking the front wall and the back wall into place (step 1506). when locked, the front wall and the back wall provides monocoque support to the roof. The unit is now completed and ready for occupancy.

Figure 16:
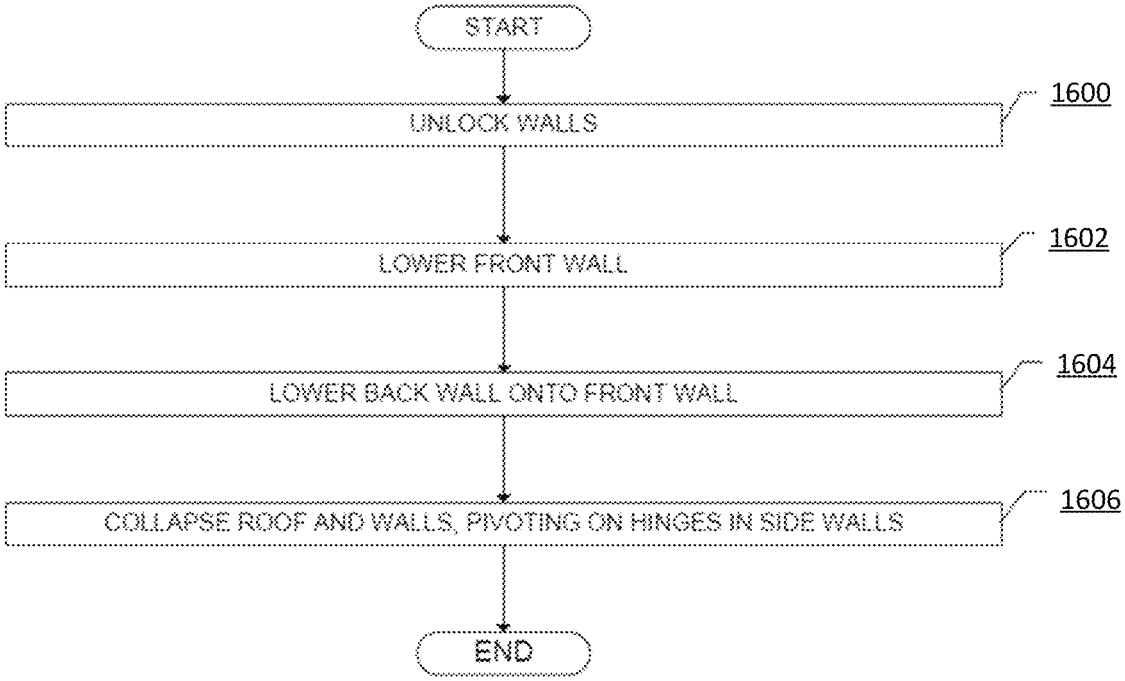
FIG. 16 shows a method of collapsing a collapsible shelter, in accordance with one or more embodiments of the invention.

FIG. 16 shows a method of collapsing a collapsible shelter.

From an interior of the shelter, an individual may access the locking mechanisms securing the front wall and the back wall to one or more of the roof or sidewall, and unlock the front wall and the back wall (step 1600). The front wall is attached to the floor using a hinge, allowing for an individual to easily lower the wall into a collapsed position atop the floor (step 1602).

Likewise, the back wall, which is currently in an erected position over the floor, collapsed in the same manner as the back wall. The back wall is attached to the floor using a hinge, allowing for an individual to easily lower the back wall into a collapsed position atop the front wall (step 1604).

The roof is collapsed, with the sidewalls pivoting on hinges into a collapsed position (step 1606). With the use of the folding handles on the roof edges, personnel lower the roof into a collapsed position. The double folding walls precede the attached roof into their collapsed position atop the back wall, with the roof resting atop the sidewalls.

While the various steps in the steps of erecting or collapsing the shelter are presented and described sequentially, one of ordinary skill will appreciate that some or all of the steps may be executed in different orders, may be combined, or omitted, and some or all of the steps may be executed in parallel. Furthermore, the steps may be performed actively or passively.

Thus, the embodiments of the present invention address and overcome a need to house people who have been displaced from permanent homes or facilities. The collapsible (rapid set) shelters of the one or more embodiments overcome this problem by providing a hard-shelled shelter to protect individuals from the environment along with providing security.

Using a combination of light-weight materials, the shelter is rugged but still easily handled through the use of manpower when handling equipment is not available. In some cases, tools for construction of shelters will not be readily available, which creates the need for a shelter which can be quickly setup with no tools. Whereas electricity may also not be available, the Rapid set shelter can still perform the functions of a shelter without a power source.

The shelter can be quickly collapsed, transported, and redeployed when and where needed. The shelter can be deployed in clusters to support many people in a small area. Low power requirements of the shelter allows for connecting multiple units to a single power source. The design configuration of the Rapid set shelter maintains all components are contained together while in the collapsed mode leaving no loose components required for this shelter.

In the preceding detailed description of embodiments, numerous specific details are set forth in order to provide a more thorough understanding of the one or more embodiments. However, it will be apparent to one of ordinary skill in the art that the one or more embodiments may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

The term "about," when used with respect to a physical property that may be measured, refers to an engineering tolerance anticipated or determined by an engineer or manufacturing technician of ordinary skill in the art. The exact quantified degree of an engineering tolerance depends on the product being produced and the technical property being measured. For a non-limiting example, two angles may be "about congruent" if the values of the two angles are within ten percent of each other. However, if an engineer determines that the engineering tolerance for a particular product should be tighter, then "about congruent" could be two angles having values that are within one percent of each other. Likewise, engineering tolerances could be loosened in other embodiments, such that "about congruent" angles have values within twenty percent of each other. In any case, the ordinary artisan is capable of assessing what is an acceptable engineering tolerance for a particular product, and thus is capable of assessing how to determine the variance of measurement contemplated by the term "about."

As used herein, the term "connected to" contemplates at least two meanings. In a first meaning, unless otherwise stated, "connected to" means that component A was, at least at some point, separate from component B, but then was later joined to component B in either a fixed or a removably attached arrangement. In a second meaning, unless otherwise stated, "connected to" means that component A could have been integrally formed with component B. Thus, for example, assume a bottom of a pan is "connected to" a wall of the pan. The term "connected to" may be interpreted as the bottom and the wall being separate components that are snapped together, welded, or are otherwise fixedly or removably attached to each other. Additionally, the term "connected to" also may be interpreted as the bottom and the wall being contiguously together as a monocoque body formed by, for example, a molding process. In other words, the bottom, and the wall, in being "connected to" each other, could be separate components that are brought together and joined, or may be a single piece of material that is bent at an angle so that the bottom panel and the wall panel are identifiable parts of the single piece of material.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A device comprising:

a bottom wall comprising:

a base plate comprising one or more metal sheets of a first thickness;

a top skin comprising one or more metal sheets of a second thickness that is less than the first thickness; and a foamed polymeric core sandwiched between the base plate and the top skin;

a first sidewall connected to the bottom wall via a first hinge and connected to a top wall via a second hinge, wherein a third hinge is disposed in the first sidewall about parallel to both the first hinge and the second hinge;

a second sidewall connected to the bottom wall via a fourth hinge and connected to the top wall via a fifth hinge, wherein a sixth hinge is disposed in the second sidewall about parallel to both the fourth hinge and the fifth hinge, wherein the second sidewall is opposite the first sidewall, and wherein the third hinge of the first sidewall and the sixth hinge of the second sidewall have about a co-equal height along the side first and second sidewalls, relative to the bottom wall;

a third sidewall connected to the bottom wall via a seventh hinge; and a fourth sidewall connected to the bottom wall via an eight hinge, wherein the fourth sidewall is configured to fold onto the bottom wall, and wherein the third sidewall is configured to fold onto the fourth sidewall in a collapsed position of the device.

2. The device of claim 1, further comprising one or more locking mechanisms to lock one or more of the first sidewall, the second sidewall, the third sidewall, and the fourth sidewall in place in an erected position of the device.

3. The device of claim 1, where in the third sidewall further comprises a door.

4. The device of claim 1, where in the fourth sidewall further comprises a window.

5. The device of claim 4, where in the fourth sidewall further comprises and air conditioner adaptor plate.

6. The device of claim 5, further comprising an air conditioning unit, removably attachable to the air conditioner adaptor plate.

7. The device of claim 5, where in the air conditioner adaptor plate further comprises a power receptacle.

8. The device of claim 1, wherein one or more of the first sidewall, the second sidewall, the third sidewall, and the fourth sidewall further comprises:

a first fiber-reinforced polymeric sheet forming an interior surface of a sidewall;

a second fiber-reinforced polymeric sheet forming an exterior surface of the sidewall;

a foamed polymeric core sandwiched between the interior surface and the exterior surface; and a support channel secured around a perimeter of the sidewall.

9. The device of claim 1, wherein the base plate comprises one or more metal sheets of 20 gauge cold-rolled steel.

10. The device of claim 1, wherein the top skin comprises one or more metal sheets of 22 gauge cold-rolled steel.

11. The device of claim 1, wherein the bottom wall further comprises:

a flooring adhered to the top skin, wherein the flooring comprises a thermoplastic resin or vinyl.

12. The device of claim 1, wherein the top wall further comprises:

a support channel secured around a perimeter of the top wall;

one or more handles attached to the support channel; and one or more brackets attached to the support channel.

13. The device of claim 12, wherein the support channel is form from a lightweight metal selected from a group consisting of aluminum, magnesium, and titanium.

* * * * *